US009408519B2

(12) United States Patent
Fischer et al.

(10) Patent No.: US 9,408,519 B2
(45) Date of Patent: Aug. 9, 2016

(54) DISHWASHER SUPPORT STRUCTURES TO REDUCE ROTATION OF A DOOR CROWN

(71) Applicant: Whirlpool Corporation, Benton Harbor, MI (US)

(72) Inventors: Marcus R. Fischer, Stevensville, MI (US); Daniel W. Southworth, South Bend, IN (US); Anthony B. Welsh, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 108 days.

(21) Appl. No.: 13/685,752

(22) Filed: Nov. 27, 2012

(65) Prior Publication Data

US 2014/0145572 A1 May 29, 2014

(51) Int. Cl.
*A47L 19/02* (2006.01)
*A47L 15/42* (2006.01)

(52) U.S. Cl.
CPC ..... *A47L 15/4257* (2013.01)

(58) Field of Classification Search
CPC ..... A47L 15/4257; A47L 15/4265; A47L 15/4259
USPC ..... 312/228; 16/110.1, 111.1, 412, 415, 16/430
See application file for complete search history.

(56) References Cited

U.S. PATENT DOCUMENTS

| | | | | | |
|---|---|---|---|---|---|
| 4,732,431 | A * | 3/1988 | Mason | 312/109 |
| 5,174,618 | A * | 12/1992 | Kropf | 292/254 |
| 5,355,554 | A * | 10/1994 | Magoon | 16/412 |
| 5,927,836 | A * | 7/1999 | Herr et al. | 312/244 |
| 7,578,566 | B2 * | 8/2009 | DiEnno et al. | 312/204 |
| 7,594,513 | B2 | 9/2009 | VanderRoest et al. | |
| 2010/0139717 | A1 * | 6/2010 | Olesen et al. | 134/56 D |
| 2011/0192430 | A1 | 8/2011 | Baldwin | |
| 2011/0247276 | A1 * | 10/2011 | Egger et al. | 49/460 |
| 2013/0113351 | A1 * | 5/2013 | Eng | 312/228.1 |
| 2013/0300268 | A1 * | 11/2013 | Schaefer et al. | 312/228 |

* cited by examiner

*Primary Examiner* — Daniel J Troy
*Assistant Examiner* — Timothy M Ayres

(57) ABSTRACT

Support structures that reduce rotation of a door crown are disclosed. An example dishwasher for treating dishes according to a cycle of operation includes a tub defining a treating chamber with an opening, and a door movably mounted to the tub to selectively open and close the opening. The door may include a front panel, a pocket panel coupled to the front panel and defining an opening in the front panel to receive a hand, a crown attached to a top of the front panel, a pocket handle defined in the crown having a first support structure engaging a second support structure of the pocket panel to reduce a rotation of the crown.

12 Claims, 4 Drawing Sheets

18

DISHWASHER SUPPORT STRUCTURES TO REDUCE ROTATION OF A DOOR CROWN

FIELD OF THE DISCLOSURE

This disclosure relates generally to dishwashers, and, more particularly, to support structures that reduce rotation of a door crown.

BACKGROUND

Dishwashers may have a configuration based on a tub that defines a treating chamber in which items are placed for cleaning and/or drying according to a cycle of operation. A dispensing system may be provided for dispensing a treating chemistry as part of the cycle of operation. A controller may be operably connected with the dispensing system and various other components of the dishwasher to execute the cycle of operation. The cycle of operation may be selected manually by the user or automatically based on one or more conditions determined by the controller.

SUMMARY

Support structures that reduce rotation of a door crown are disclosed. An example dishwasher for treating dishes according to a cycle of operation includes a tub defining a treating chamber with an opening, and a door movably mounted to the tub to selectively open and close the opening. The door may include a front panel, a pocket panel coupled to the front panel and defining an opening in the front panel to receive a hand, a crown attached to a top of the front panel, a pocket handle defined in the crown having a first support structure engaging a second support structure of the pocket panel to reduce a rotation of the crown.

DETAILED DESCRIPTION

Figure 1:
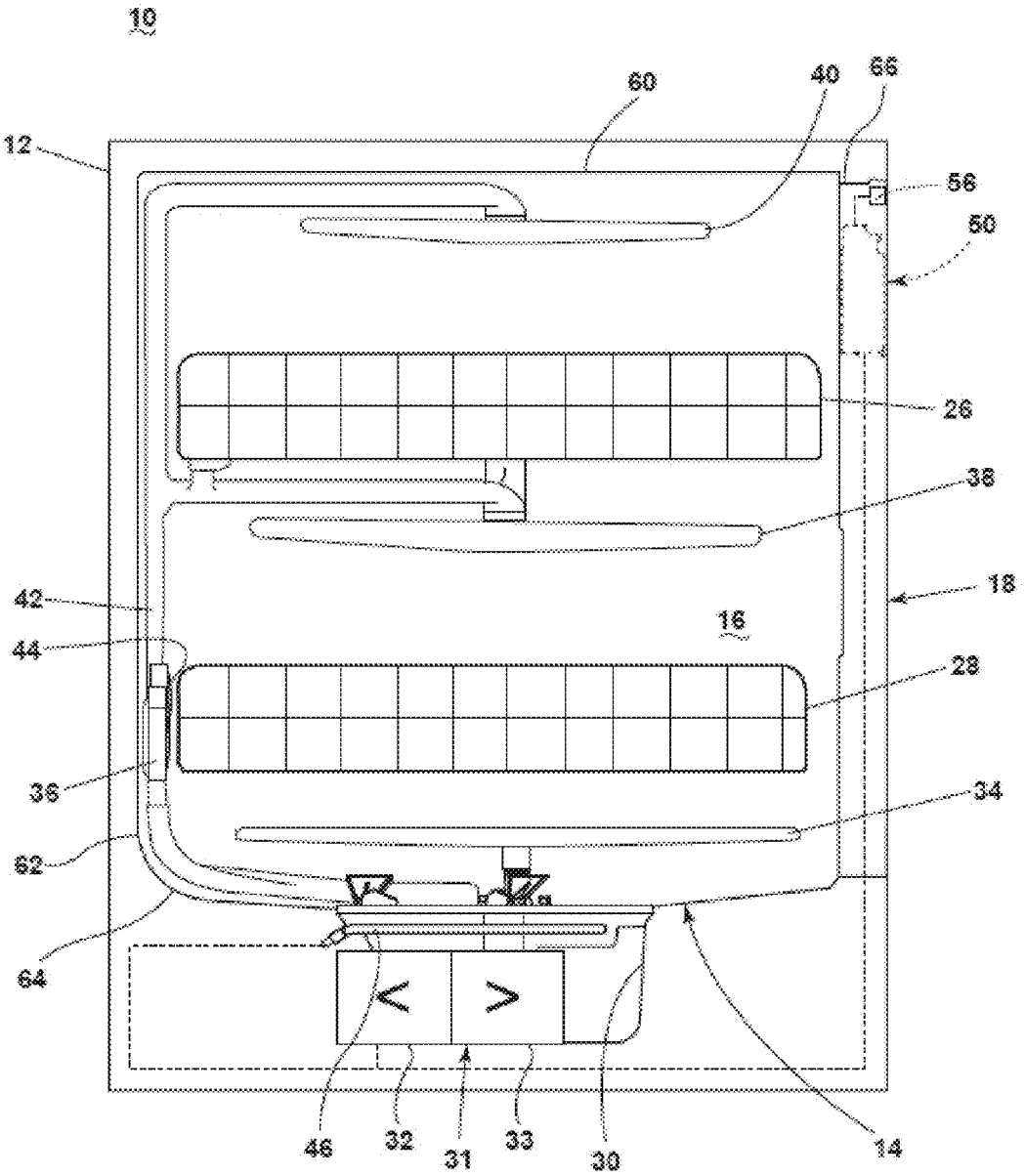
FIG. 1 is a schematic, side cross-sectional view of an example dishwasher.

In FIG. 1, an automated dishwasher 10 according to a disclosed embodiment is illustrated. The dishwasher 10 shares many features of a conventional automated dishwasher, which will not be described in detail herein except as necessary for a complete understanding of this disclosure. A chassis or frame 12 may define an interior of the dishwasher 10 and may include a frame, with or without panels mounted to the frame. An open-faced tub 14 may be provided within the chassis 12 and may at least partially define a treating chamber 16, having an open face, for washing dishes. A door 18 may be movably (e.g., rotationally) mounted to the dishwasher 10 for movement between opened and closed positions to selectively open and close the open face of the tub 14. Thus, the door 18 provides accessibility to the treating chamber 16 for the loading and unloading of dishes or other washable items. Example manners of implementing the door 18 are described below in connection with FIGS. 3-5.

It should be appreciated that the door 18 may be secured to the lower front edge of the chassis 12 or to the lower front edge of the tub 14 via a hinge assembly (not shown) configured to pivot the door 18. When the door 18 is closed, user access to the treating chamber 16 may be prevented, whereas user access to the treating chamber 16 may be permitted when the door 18 is open.

Dish holders, illustrated in the form of upper and lower dish racks 26, 28, are located within the treating chamber 16 and receive dishes or other items for washing and/or drying. The upper and lower racks 26, 28 may be mounted to dish rack mounts (not shown) via disk rack rails (not shown) for slidable movement in and out of the treating chamber 16 for ease of loading and unloading. Other dish holders may be provided, such as a silverware basket. As used in this disclosure, the term "dish(es)" is intended to be generic to any item, single or plural, that may be treated in the dishwasher 10, including, without limitation, dishes, plates, pots, bowls, pans, glassware, utensils, and silverware.

A spray system is provided for spraying liquid in the treating chamber 16 and is provided in the form of a first lower spray assembly 34, a second lower spray assembly 36, a rotating mid-level spray arm assembly 38, and/or an upper spray arm assembly 40. Upper sprayer 40, mid-level rotatable sprayer 38 and lower rotatable sprayer 34 are located, respectively, above the upper rack 26, beneath the upper rack 26, and beneath the lower rack 28 and are illustrated as rotating spray arms. The second lower spray assembly 36 is illustrated as being located adjacent the lower dish rack 28 toward the rear of the treating chamber 16. The second lower spray assembly 36 is illustrated as including a vertically oriented distribution header or spray manifold 44. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system is provided for recirculating liquid from the treating chamber 16 to the spray system. The recirculation system may include a sump 30 and a pump assembly 31. The sump 30 collects the liquid sprayed in the treating chamber 16 and may be formed by a sloped or recess portion of a bottom wall of the tub 14. The pump assembly 31 may include both a drain pump 32 and a recirculation pump 33. The drain pump 32 may draw liquid from the sump 30 and pump the liquid out of the dishwasher 10 to a household drain line (not shown). The recirculation pump 33 may draw liquid from the sump 30 and the liquid may be simultaneously or selectively pumped through a supply tube 42 to each of the assemblies 34, 36, 38, 40 for selective spraying. While not shown, a liquid supply system may include a water supply conduit coupled with a household water supply for supplying water to the treating chamber 16.

A heating system including a heater 46 may be located within the sump 30 for heating the liquid contained in the sump 30.

A controller 50 may also be included in the dishwasher 10, which may be operably coupled with various components of the dishwasher 10 to implement a cycle of operation. The controller 50 may be located within the door 18 as illustrated, or it may alternatively be located somewhere within the chassis 12. The controller 50 may also be operably coupled with a control panel or user interface 56 for receiving user-selected inputs and communicating information to the user. The user interface 56 may include operational controls such as dials, lights, switches, and displays enabling a user to input commands, such as a cycle of operation, to the controller 50 and receive information. In some examples, the controller 50 and the user interface 56 may be implemented in a crown of the door 18. As used herein, the crown of a door is a member of a door that forms the top portion of the door. Generally, the crown of the door is attached to front and rear panels of the door during assembly/manufacture.

Figure 2:
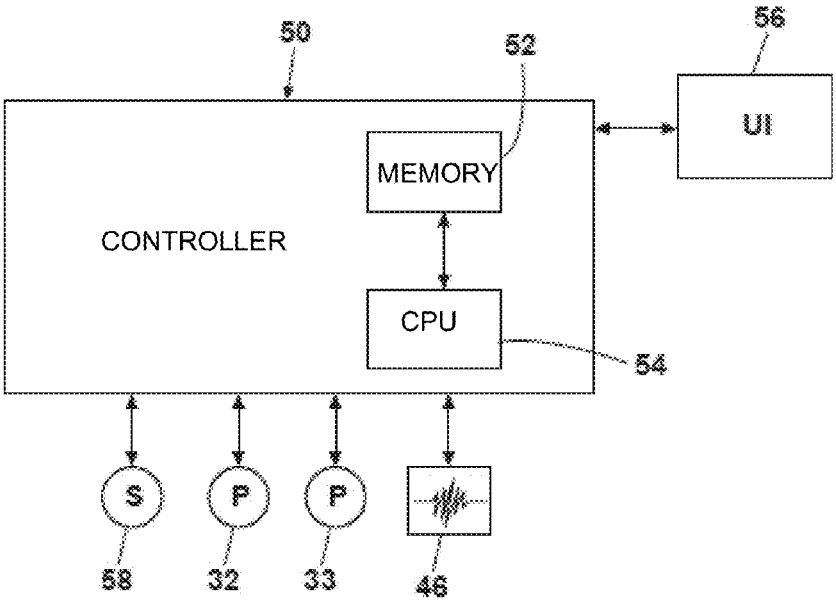
FIG. 2 is a schematic view of the controller of the example dishwasher of FIG. 1.

As illustrated schematically in FIG. 2, the controller 50 may be coupled with the heater 46 for heating the wash liquid during a cycle of operation, the drain pump 32 for draining liquid from the treating chamber 16, and the recirculation pump 33 for recirculating the wash liquid during the cycle of operation. The controller 50 may be provided with a memory 52 and a central processing unit (CPU) 54. The memory 52 may be used for storing control software that may be executed by the CPU 54 in completing a cycle of operation using the dishwasher 10 and any additional software. For example, the memory 52 may store one or more pre-programmed cycles of operation that may be selected by a user and completed by the dishwasher 10. The controller 50 may also receive input from one or more sensors 58. Non-limiting examples of sensors that may be communicably coupled with the controller 50 include a temperature sensor and turbidity sensor to determine the soil load associated with a selected grouping of dishes, such as the dishes associated with a particular area of the treating chamber.

Figure 3:
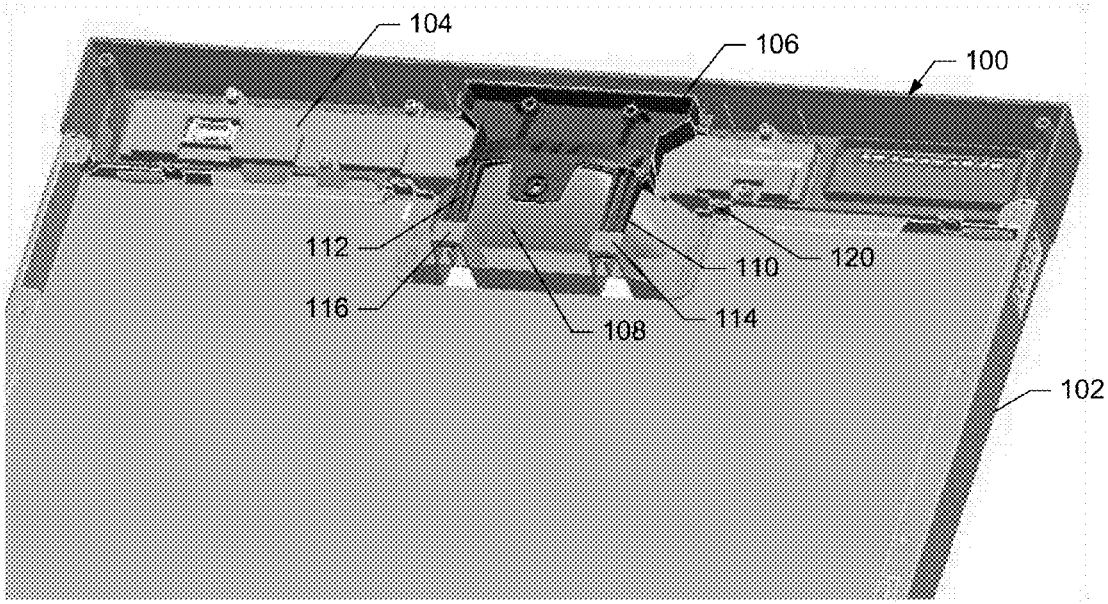
FIG. 3 is an isometric view of an example support structure for the example door of FIG. 1 that reduces rotation of a door crown.

FIG. 3 is an isometric view showing a crown 100 attached to a front panel 102 of the example door 18 of FIG. 1. In some examples, the crown 100 is formed of a plastic, and the front panel 102 is formed of a metal. In the example of FIG. 3, the example controller 50 and the user interface 56 are implemented in an electronics module 104.

To allow a user to open and close the door 18, the example crown 100 includes a pocket handle member 106. As shown in the cross-section of FIG. 4, the pocket handle member 106 defines an opening, grip or handle into which a person may put their hand in order to pull or push the door 18 open or closed.

To enable a user to get their hand into the pocket handle 106, the example front panel 102 includes a pocket panel member 108 that defines an opening in the front panel 102 into which they may place their hand. The pocket panel member 108 enables a person to place their fingers into the pocket handle member 106.

When a user pulls on the pocket handle member 106, the crown 100 may rotate relative to the front panel 102. In particular, when the bottom of the pocket handle member 106 substantially corresponds to the bottom edge of the crown 100 (e.g., for aesthetic reasons), pulling on the pocket handle member 106 exerts a rotational force on the crown 100. If the crown 100 rotates relative to the front panel 102, the aesthetics of the door 18 and/or the dishwasher 10 may be diminished, and perceived quality and/or customer satisfaction may be negatively affected. Accordingly, it is desirable to prevent and/or reduce rotation of the crown 100.

Figure 4:
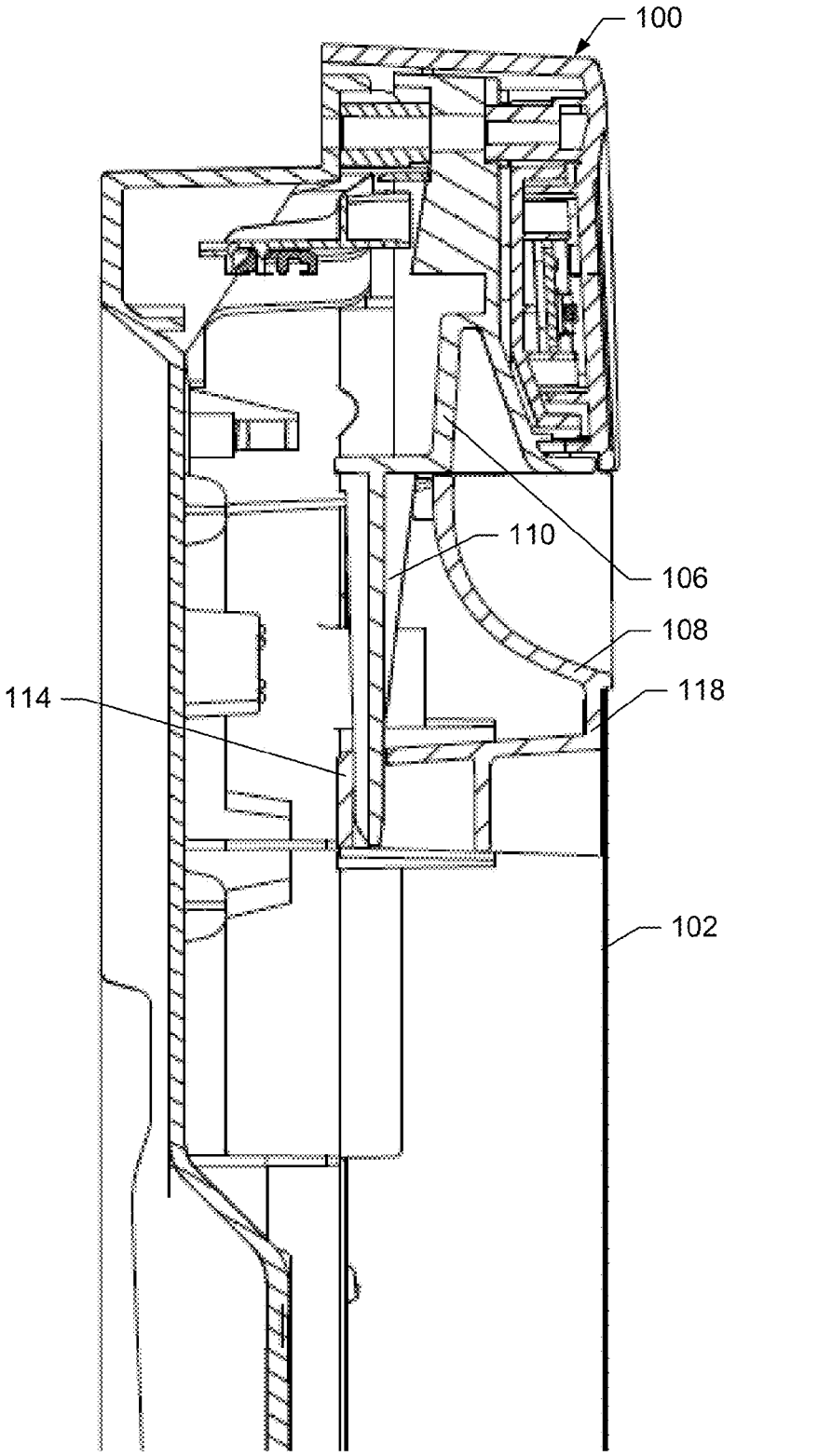
FIG. 4 is a side cross-sectional view of the example door of FIG. 3 taken through the support structure of FIG. 3.

To reduce and/or prevent rotation of the crown 100, the pocket handle member 106 includes support structures 110 and 112 that extend downward into corresponding support structures 114 and 116 of the pocket panel member 108. The cross-sectional view of FIG. 4 is taken through the support structures 110 and 114. As shown in FIG. 3, the support structures 110 and 112 may be ribbed to increase strength. The support structures 110 and 112 extend downward through openings defined in the support structures 114 and 116, which extend backward from the pocket panel member 108. In some examples, the support structures 110 and 112 are slip fit into the support structures 114 and 116 to reduce the need for any additional fasteners and/or reduce complexity of manufacturing assembly.

When a user pulls on the pocket handle member 106, any rotational force applied to the crown 100 will be substantially transferred to the pocket panel member 108 via the support structures 110, 112, 114 and 116. Because a lip 118 (see FIG. 4) of the pocket panel member 108 is behind the front panel 102, the pocket panel member 108 substantially transfers the transferred rotation force to the front panel 102, thereby reducing and/or substantially preventing rotation of the crown 100. That is, the front panel 102 exerts a resistive force that counteracts the transferred force and, thus, the rotational force, thereby substantially preventing rotation of the crown 100.

Figure 5:
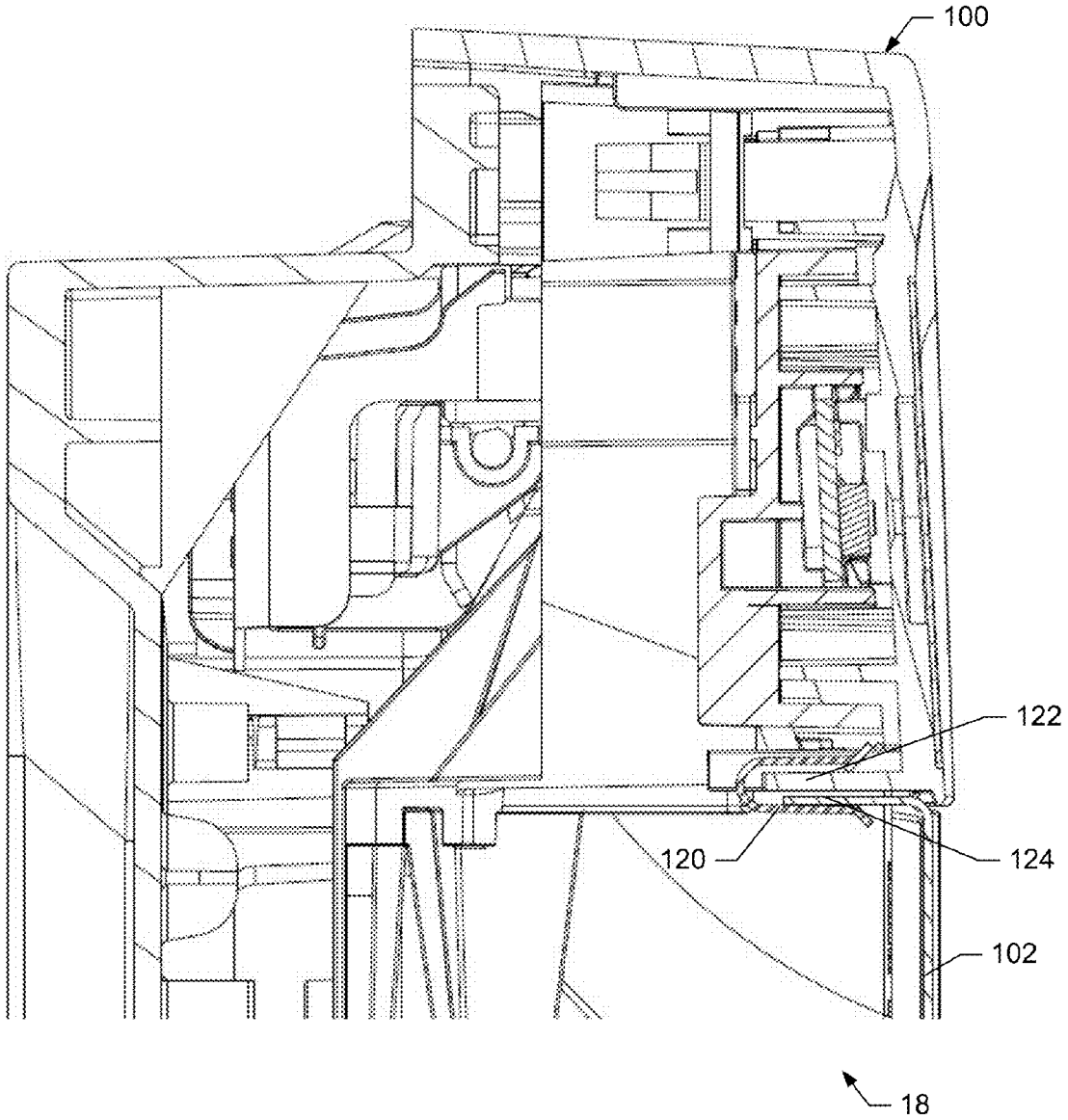
FIG. 5 is a side cross-sectional view of the example door of FIG. 3 taken through a clip of FIG. 3.

To reduce and/or prevent vertical separation of the crown 100 from the front panel 102, the example door 18 of FIGS. 1 and 3 includes clips (one of which is designated at reference numeral 120). In some examples, four clips are used. FIG. 5 is a side cross-sectional view taken through the example clip 120. As shown more clearly in FIG. 5, the clip 120 fixedly attaches a bottom lip 122 of the crown 100 to a top lip 124 of the front panel 102 to reduce a separation of the crown 100 from the front panel 102.

Although certain example methods, apparatus and articles of manufacture have been described herein, the scope of coverage of this patent is not limited thereto. On the contrary, this patent covers all methods, apparatus and articles of manufacture fairly falling within the scope of the claims of this patent.

What is claimed is:

1. A dishwasher for treating dishes according to a cycle of operation, the dishwasher comprising:

a tub defining a treating chamber with an opening; and a door movably mounted to the tub to selectively open and close the opening, the door including:

a front panel;

a pocket panel fixedly coupled to the front panel and defining an opening in the front panel to receive a hand, the pocket panel including a lip at a bottom portion thereof, a front surface of the lip abutting a rear surface of the front panel;

a crown attached to a top of the front panel;

a pocket handle fixedly coupled in the crown, the pocket handle defining a recess in the crown to receive the hand, an edge portion of the pocket handle abutting a corresponding edge portion of the pocket panel;

a first support structure extending downward from a rear bottom portion of the pocket handle, behind the pocket panel;

a second support structure extending rearward from the lip of the pocket panel to reduce a rotation of the crown, wherein the first support structure extends through an opening in the second support structure to engage the first support structure and the second support structure; and a clip to fixedly attach a bottom lip of the crown to a top lip of the front panel to reduce a separation of the crown from the front panel, wherein the clip comprises:

an upper portion, a lower portion; and a central portion extending between the upper portion and the lower portion, wherein:

the bottom lip of the crown abuts the top lip of the front panel, the clip fixes the bottom lip of the crown to the top lip of the front panel, the upper portion of the clip contact am upper surface of the bottom lip of the crown, the lower portion of the clip contacts a lower surface of the top lip of the front panel, and the central portion of the clip extends along distal ends of the top lip of the front panel and the bottom lip of the crown.

2. The dishwasher as defined in claim 1, wherein the first support structure transfers a rotational force applied to the pocket handle to the pocket panel, and the pocket panel transfers the transferred force to the front panel via the lip of the pocket panel to reduce the rotation of the crown.

3. The dishwasher as defined in claim 1, wherein the rotation occurs when a user pulls the pocket handle to selectively open the opening.

4. The dishwasher as defined in claim 1, wherein the first support structure comprises an elongated ribbed extension member extending downward from the pocket handle.

5. The dishwasher as defined in claim 1, wherein a bottom of the pocket handle corresponds to a bottom of the crown.

6. The dishwasher as defined in claim 1, further comprising a user interface defined in the crown.

7. The dishwasher as defined in claim 1, wherein the front panel comprises a metal material, and a housing of the crown comprises a plastic material.

8. The dishwasher as defined in claim 1, wherein the crown comprises:

a first member defining a housing of the crown; and a second member attached to the first member and defining the pocket handle.

9. The dishwasher as defined in claim 1, wherein engagement of the first support structure and the second support structure restricts relative movement of the first support structure and the second support structure.

10. The dishwasher as defined in claim 1, wherein the first support structure is integrally formed with the pocket handle, and the second support structure is integrally formed with the pocket panel.

11. The dishwasher as defined in claim 1, wherein the first support structure includes:

a first handle support member extending downward from a first lateral end portion of the rear bottom portion of the pocket handle; and a second handle support member extending downward from a second lateral end portion of the rear bottom portion of the pocket handle.

12. The dishwasher as defined in claim 11, wherein the second support structure includes:

a first panel support member extending rearward from a first lateral end portion of the pocket panel, at a position corresponding to a position of the first handle support member; and a second panel support member extending rearward from a second lateral end portion of the pocket panel, at a position corresponding to a position of the second handle support member.

* * * * *